US006802706B2

(12) United States Patent
Collesan

(10) Patent No.: US 6,802,706 B2
(45) Date of Patent: Oct. 12, 2004

(54) DEVICE AND METHOD TO OPTIMIZE COMBUSTION OF HYDROCARBONS

(75) Inventor: Antonio Collesan, Udine (IT)

(73) Assignee: E-Col. Energy SRL, Travesio (IT)

( * ) Notice: Subject to any disclaimer, the term of this patent is extended or adjusted under 35 U.S.C. 154(b) by 155 days.

(21) Appl. No.: 10/214,502

(22) Filed: Aug. 8, 2002

(65) Prior Publication Data

US 2003/0036027 A1 Feb. 20, 2003

Related U.S. Application Data

(63) Continuation of application No. PCT/IB01/00151, filed on Feb. 6, 2001.

(30) Foreign Application Priority Data

Sep. 2, 2000 (IT) ..... UD2000A0026

(51) Int. Cl.[7] ..... F02M 27/04; F02B 51/04

(52) U.S. Cl. ..... 431/2; 431/18; 123/537; 123/538

(58) Field of Search ..... 431/2, 18; 123/536–539

(56) References Cited

U.S. PATENT DOCUMENTS

| | | | | | |
|---|---|---|---|---|---|
| 3,830,621 | A | | 8/1974 | Miller | |
| 3,943,407 | A | | 3/1976 | Bolasny | |
| 3,976,726 | A | | 8/1976 | Johnson | |
| 4,461,262 | A | * | 7/1984 | Chow | 123/536 |
| 5,159,915 | A | * | 11/1992 | Saito et al. | 123/557 |
| 5,331,807 | A | | 7/1994 | Hricak | |
| 5,342,586 | A | * | 8/1994 | Park | 422/211 |

FOREIGN PATENT DOCUMENTS

| | | | | |
|---|---|---|---|---|
| EP | 0 652 362 A1 | | 5/1995 | |
| EP | 661424 A1 | * | 7/1995 | F02B/51/04 |
| EP | 0 894 969 A2 | | 2/1999 | |
| WO | WO 00/15957 A1 | | 3/2000 | |

* cited by examiner

*Primary Examiner*—Ira S. Lazarus
*Assistant Examiner*—James G. Barrow
(74) *Attorney, Agent, or Firm*—Akin Gump Strauss Hauer & Feld, L.L.P.

(57) ABSTRACT

Device (10) and method to optimize the combustion of hydrocarbons able to be used as fuel and mixed with air containing oxygen, said device (10) comprising means (20, 23) to generate a magnetic field, advantageously of the pulsating type, in correspondence with a fuel feed pipe (13).

21 Claims, 2 Drawing Sheets

DEVICE AND METHOD TO OPTIMIZE COMBUSTION OF HYDROCARBONS

CROSS-REFERENCE TO RELATED APPLICATIONS

This application is a continuation of International Application No. PCT/IB01/00151, filed Feb. 6, 2001, which was published in the English language on Aug. 16, 2001, under International Publication No. WO 01/59368 A1 and the disclosure of which is incorporated herein by reference.

BACKGROUND OF THE INVENTION

This invention concerns a device, and the relative method, to optimize the combustion of hydrocarbons in general, and in particular those used as fuel in combustion engines, both Otto engines and Diesel engines, and in burners for heating systems or other plants.

The device and method according to the invention increase the percentage of fuel actually burnt, and obtain a consequent reduction of the residual material emitted from the exhaust pipes of the engine or from the chimney associated with the burner. We thus obtain a greater energy yield and a drastic reduction in the atmospheric pollution produced by combustion.

It is well-known that liquids in general and hydrocarbons in particular consist of molecules containing positive charges and negative charges which tend to polarize with each other, that is, they distribute themselves in an orderly manner, with each pole associated, by attraction, with the opposite pole of the nearby molecule, so that we have a natural phenomenon of surface tension.

It is also known that if no outside force is applied to a liquid formed of polarized molecules, then precisely because of the surface tension, the liquid tends not to divide below a minimum dimension and to form little drops, substantially spherical, since this is the form with the lowest energy content.

When hydrocarbons are used as fuel, the surface tension in each individual drop prevents the oxygen from combining completely and in an optimum manner with the parts of carbon at the deepest part of the drops; therefore, some of the latter do not participate in the combustion process, or else they burn badly due to the lack of oxygen.

It has also been known for a long time how combustion engines behave—both Otto engines using petrol, and Diesel engines using diesel oil—where the fuel is injected into each cylinder by means of an injection system, just before the upward, compression travel of the relative piston finishes.

Both in combustion engines and in burners, the fuel is injected in the form of one or more jets, through holes or nozzles, divides into small drops and penetrates into the combustion chamber, mixing with the air, which in turn is introduced at a particular pressure and temperature.

Therefore, we have a rapid combustion of the fuel-air mix, which occurs either caused by a controlled ignition, as in petrol engines, or spontaneously, due to the high pressure of the mixture itself, as in Diesel engines.

One of the disadvantages of known systems is that not all the fuel mixed with the air and introduced into the combustion chamber is burnt, so that a part of its energy—which may even be considerable—is not used, but expelled from the engine or the burner through the exhaust pipe or, respectively, the chimney. This has very harmful effects both for the outer environment, which is polluted, and also for the energy cost in general, considering the cost of the hydrocarbons.

The state of the art includes, among others, the documents EP-A-0652362, EP-A-0894969, U.S. Pat. Nos. 3,830,621, 3,943,407, 3,976,726 and 5,331,807.

To be more exact, EP-A-0652362 describes a device and method to reduce the consumption of fossil fuel by means of a magnetic field generated by a generator of rectangular pulses having a frequency of between 10 and 200 Hz.

EP-A-0894969 describes a device in which the frequency of the pulses which generate the magnetic field are between 1,000 and 5,000 Hz.

U.S. Pat. No. 3,976,726 describes a device to activate the fuel wherein a coil, associated with the fuel pipe, generates a frequency in a range of 16–42 MHz.

The present Applicant has devised, tested and embodied this invention to overcome these shortcomings and to obtain further advantages.

BRIEF SUMMARY OF THE INVENTION

The invention is set forth and characterized in the main claims, while the dependent claims describe other innovative characteristics of the invention.

The main purpose of the invention is to achieve a device and method which will optimize the combustion of hydrocarbons and which will make possible that the whole quantity of fuel introduced into an engine or a burner, even the innermost parts of every single drop, can give up its inner energy.

In accordance with this purpose, the device and method according to the invention use a magnetic field, advantageously of the pulsating type, generated in correspondence with the fuel feed pipe. The magnetic field is able to induce vibrations in the individual drops of fuel which reduce the surface or pellicular tension in the drops.

In this way, the drops of fuel are not only agitated, and therefore mix more easily with the oxygen comburent, but each of them is also broken up and fractionated into tiny parts. Each micro-drop, or fraction of drop, can thus interact and combine completely with the oxygen and burn totally, give up all its energy and not remain unburned.

The phenomenon of vibration, characteristic of the magnetic field, also affects the behavior of the atoms and the typical frequencies of the orbits of the electrons, for example of the carbon contained in the hydrocarbon which, at an innermost level, enter more easily into combination with those of the oxygen, thus encouraging the phenomenon of oxide reduction during the combustion step.

The magnetic field is generated by the passage of a variable current in a solenoid coil associated with the pipe through which the fuel flows. The magnetic field acts on the molecules of the fuel, making them more reactive to combustion.

A percentage of molecules in the fuel acts as a catalyzer to the reaction, extending the field of inflammability of the fuel-air mixture. This allows, for example in Diesel engines, the self-ignition of a set mixture at a lower temperature and pressure, with the consequent result that the engine gives a better performance with the same consumption; or it allows self-ignition at pre-set temperature and pressure, with lower concentrations of fuel, with the result that the engine uses less fuel with the same performance.

The device according to the invention is able to positively influence the functioning of the engine on which it is installed, as if the engine itself, in the case of a Diesel engine, were fed with a fuel with a higher cetane rating. The reduced delay at ignition, and the more careful control of combustion, make the engine trimmer and less rough.

Moreover, when the device according to the invention is applied, we obtain a longer duration of the combustion step with a controlled mix, and a consequent reduction in the formation of particulate, since the fuel does not stagnate in the combustion chamber in richer zones in the quantity of jet, where particulate is typically formed, but is made available for combustion.

In engines where the device according to the invention is installed, with the same power delivered, it is possible to reduce the quantity of fuel fed with the advantage of reduced consumption.

According to one characteristic of the invention, the magnetic field is generated by a signal with a modulated amplitude. To be more exact, an electric circuit generates a carrier with a frequency between 1 and 30 MHz, advantageously about 20 MHz, which is then modulated in amplitude between a value of zero and a defined value $V_1$, a few volts, advantageously from 6 to 12 V, so as to generate bunches of pulses with a modulating frequency of between 50 and 1,000 Hz.

The invention provides that the feed pipe for the comburent is also affected by radio waves of the pulsating type: they are generated by a suitable aerial and are in the form of bunches of pulses which generate the magnetic field associated with the fuel feed pipe. The radio waves are also able to positively influence the aforesaid magnetic field, interacting therewith.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
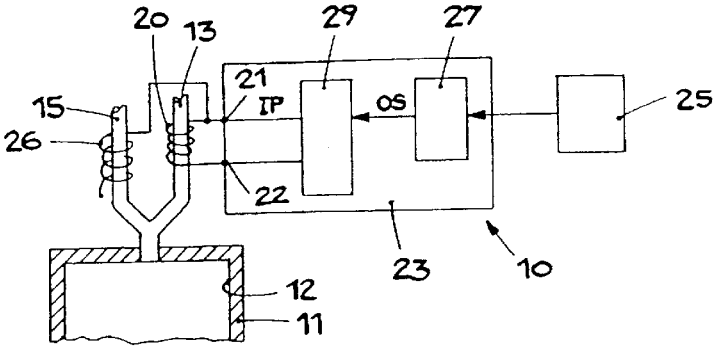
FIG. 1 is a schematic view of a device according to the invention.

With reference to FIG. 1, a device 10 according to the invention is shown applied to a combustion engine 11 having at least a combustion chamber 12, into which a fuel consisting of a hydrocarbon, such as for example petrol, diesel oil or other, and respectively a comburent, for example air, are able to be introduced through feed pipes 13 and 15.

Both the fuel and the comburent may be introduced into the combustion chamber 12 by any conventional means, such as injectors, mixers, carburettors or otherwise, and the flow is regulated by suitable valves which are not shown in the drawings.

The fuel-air mixture in the combustion chamber 12 may also be ignited by any conventional means.

According to one characteristic of the invention, the device 10 comprises a first solenoid coil 20 able to be wound around the pipe 13 and connected to the terminals 21 and 22 of an electric circuit 23 (FIGS. 1 and 2), which is connected to the electric supply 25 of the engine 11, consisting for example of an accumulator or a current generator, also of a conventional type.

A second coil 26 is able to be wound in a solenoid around the air feed pipe 15. The coil 26 has one end connected in parallel to the coil 20 and has one end free so as to effectively constitute a transmission aerial.

Figure 3:
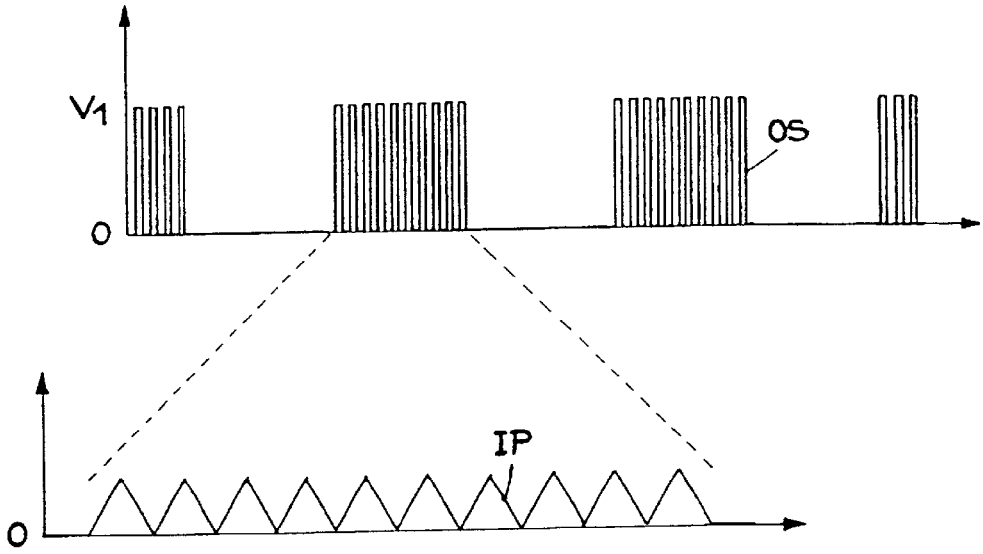
FIG. 3 is a schematic graph of some signals of the electric circuit shown in FIG. 2.

The circuit 23 comprises an oscillator 27 able to generate a signal OS (FIG. 3) consisting of a carrier with a frequency of between 1 and 30 MHz, advantageously about 20 MHz, which is modulated in amplitude between a value of zero and a defined value $V_1$, of several volts, for example from 6 to 20, so as to generate bunches of pulses with a relatively low modulating frequency, in the range of 50–1,000 Hz, advantageously 1,000 Hz.

The oscillator 27 is connected to the coil 20 by means of a power amplifier or power circuit 29 which generates a current signal IP substantially triangular in shape, according to the duty cycle of the bunches of pulses of the signal OS.

Figure 2:
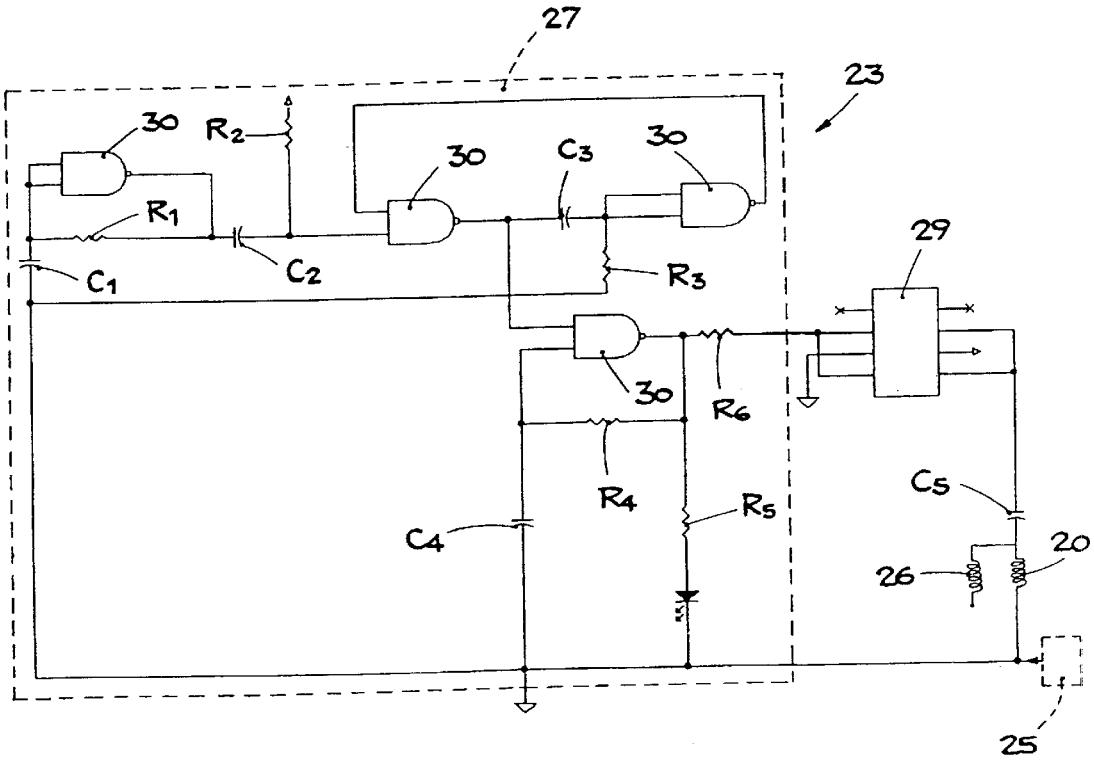
FIG. 2 is a schematic view of the electric circuit of the device according to the invention.

FIG. 2 shows an example of one embodiment of the circuit 23, wherein it can be seen that the oscillator 27 is made by logical doors 30, resistors R and condensers C, suitably connected with each other.

Figure 4:
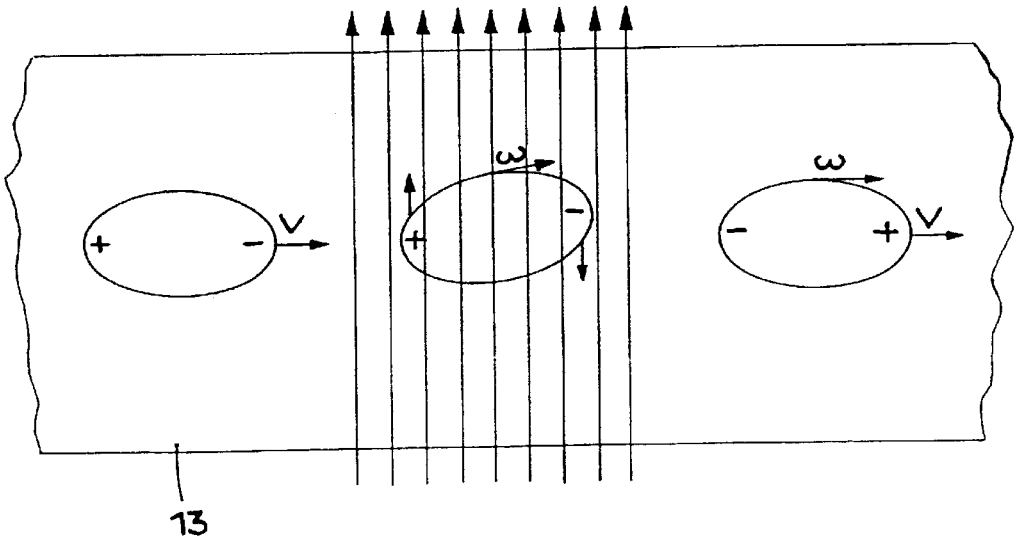
FIG. 4 is a schematic view of the development of the hydrocarbon molecules in the magnetic field generated by the electric circuit shown in FIG. 2.

The signal IP causes a pulsating magnetic field to be generated in the coil 20, which field interacts with the flow of fuel drops passing in the fuel feed pipe 13 (FIG. 4).

As the pulsating magnetic field interferes with the fuel drops, it reduces the pellicular tension in each one, thus fragmenting them into a multitude of micro-drops, and generates turbulence on a microscopic level. In this way the hydrocarbon molecules, entering at a given velocity V, which depends on the suction, are made to rotate on themselves, and in opposite directions, each with respect to each other.

In this way the two desired effects are obtained: the surface tension is weakened, which breaks the drops and divides them into micro-drops, and turbulence is formed, according to angular speeds which are indicated as an example by w, which best allow the hydrocarbons and the oxygen contained in the air introduced through the feed pipe 15 to enter into direct contact with each other.

The coil 26, which functions as an aerial, emits actual pulsating radio waves, with the same frequency and form as the signal OS. The radio waves emitted by the coil-aerial 26 also encourage in the fuel the phenomena described above.

In order to optimize the combustion of hydrocarbons able to be used as fuel and mixed with air containing oxygen, the method according to the invention therefore provides that a first magnetic field of a pulsating type is generated in correspondence with the fuel feed pipe 13.

A second magnetic field is generated by the second coil 26, arranged around the air feed pipe 15 and having one end connected in parallel to the first coil 20, and one end free so as to constitute a transmission aerial.

The device 10 according to the invention can be applied to any conventional burner, not shown in the drawings, instead of to a combustion engine 11. In this case too the coil 20 is able to be associated with the fuel feed pipe, while the coil 26 is able to be associated with the air feed pipe.

It is clear that modifications and/or additions may be made to the device 10 and method as described heretofore, without departing from the spirit and scope of the invention.

It is also clear that, although this invention is described with reference to a specific example, a person of skill in the art shall certainly be able to embody many other equivalent forms, all of which shall remain within the field and scope of the invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Device to optimize the combustion of hydrocarbons able to be used as fuel and mixed with air containing oxygen, comprising a fuel feed pipe (13), first means (20) able to generate a first magnetic field of a pulsating type associated with said fuel feed pipe (13), the device being characterized in that said first means (20) are connected to an electric circuit (23) comprising means to generate pulses (27) able to generate a signal (OS) comprising bunches of pulses having a first frequency of between 1 and 30 MHz.

2. Device as in claim 1, characterized in that second means (26) are associated with an air feed pipe (15) to generate a second magnetic field, said second means (26) being connected to said first means (20) so as to constitute a transmission aerial.

3. Device as in claim 2, characterized in that said second means comprise a second coil (26) wound in a solenoid around said air feed pipe (15), said second coil (26) having one end connected in parallel to said first coil (20) and one end free so as to constitute said transmission aerial.

4. Device as in claim 3, characterized in that said second coil (26) is able to emit pulsating radio waves with the same frequency and form as those of said signal (OS).

5. Device as in claim 1, characterized in that said first means (20) comprise a first solenoid coil (20) wound around said fuel feed pipe (13).

6. Device as in claim 5, characterized in that said oscillator (27) is connected to said first solenoid coil (20) by means of a power amplifier or power circuit (29) able to generate a current signal (IP), substantially triangular in shape, according to the duty cycle of said bunches of pulses of said signal (OS).

7. Device as in claim 1, characterized in that said signal (OS) comprises a carrier modulated in amplitude, between a value of zero and a defined value ($V_1$) of between 6 and 12 V.

8. Device as in claim 1, characterized in that said carrier is modulated to a second frequency of between 50 and 1,000 Hz.

9. Device as in claim 1, characterized in that said first frequency is about 20 MHz.

10. Device as in claim 8, characterized in that said second frequency is about 1,000 Hz.

11. Device as in claim 1, characterized in that said means to generate pulses comprise an oscillator (27).

12. Method to optimize the combustion of hydrocarbons able to be used as fuel and mixed with air containing oxygen, comprising a step wherein a first magnetic field of a pulsating type is generated by means of first means (20) associated with a fuel feed pipe (13), the method being characterized in that said first means (20) are connected to an electric circuit (23) comprising means to generate pulses (27) able to generate a signal (OS) comprising bunches of pulses having a first frequency of between 1 and 30 MHz.

13. Method as in claim 12, characterized in that a second magnetic field is generated by second means (26) associated with an air feed pipe (15), wherein said second means (26) are connected to said first means (20) so as to constitute a transmission aerial.

14. Method as in claim 13, characterized in that said second means comprise a second coil (26) wound in a solenoid around said air feed pipe (15), said second coil (26) having one end connected in parallel to said first coil (20) and one end free so as to constitute said transmission aerial.

15. Method as in claim 14, characterized in that said second coil (26) is able to emit pulsating radio waves with the same frequency and form as those of said signal (OS).

16. Method as in claim 12, characterized in that said carrier is modulated to a second frequency of between 50 and 1,000 Hz.

17. Method as in claim 16, characterized in that said second frequency is about 1,000 Hz.

18. Method as in claim 12, characterized in that said signal (OS) comprises a carrier modulated in amplitude, between a value of zero and a defined value ($V_1$) of between 6 and 12 V.

19. Method as in claim 12, characterized in that said first frequency is about 20 MHz.

20. Method as in claim 12, characterized in that said first means (20) comprise a first solenoid coil (20) wound around said fuel feed pipe (13).

21. Method as in claim 12, characterized in that said signal (OS) is generated by an oscillator (27).

* * * * *